United States Patent [19]

Kenmochi et al.

[11] Patent Number: 4,746,448

[45] Date of Patent: May 24, 1988

[54] COLD ROLLING OIL FOR STEELS

[75] Inventors: Kazuhito Kenmochi; Hideo Abe; Toru Sasaki; Takeshi Yoshimoto, all of Chiba; Hiroyuki Nagamori, Wakayama; Hiroyuki Matsuda, Kainan, all of Japan

[73] Assignees: Kao Corporation; Kawasaki Steel Corporation, both of Kobe, Japan

[21] Appl. No.: 839,994

[22] Filed: Mar. 17, 1986

[30] Foreign Application Priority Data

Apr. 3, 1985 [JP] Japan ..... 60-70450

[51] Int. Cl.[4] ..... C10M 101/04; C10M 105/134

[52] U.S. Cl. ..... 252/56 S; 252/34; 252/50; 252/51.5 R; 252/56 R; 252/52 R

[58] Field of Search ..... 252/56 R, 56 S, 50, 252/51.5 R, 34, 49.9, 49.3

[56] References Cited

U.S. PATENT DOCUMENTS

| | | | |
|---|---|---|---|
| 3,945,930 | 3/1976 | Sugiyama et al. | 252/56 S |
| 4,036,769 | 7/1977 | Zipf | 252/56 S |
| 4,062,784 | 12/1977 | Baur | 252/56 R |
| 4,096,078 | 6/1978 | Yaffee | 252/56 S |
| 4,116,872 | 9/1978 | Jahnke | 252/56 S |
| 4,178,260 | 12/1979 | Cook et al. | 252/56 S |
| 4,191,658 | 3/1980 | Jahnke | 252/56 S |
| 4,191,801 | 3/1980 | Jahnke | 252/56 S |
| 4,292,187 | 9/1981 | Hentschel et al. | 252/56 S |
| 4,554,087 | 11/1985 | Chiba | 252/49.9 |
| 4,559,153 | 12/1985 | Baldwin et al. | 252/56 R |
| 4,566,983 | 1/1986 | Hayashi | 252/56 R |
| 4,578,202 | 3/1986 | Urban et al. | 252/56 S |
| 4,585,564 | 4/1986 | Tahmata et al. | 252/56 R |
| 4,589,990 | 5/1986 | Zehler | 252/56 S |
| 4,601,840 | 7/1986 | Zehler | 252/56 S |
| 4,664,823 | 5/1987 | Kuwamoto | 252/56 S X |
| 4,693,839 | 9/1987 | Kuwamoto | 252/56 S X |

FOREIGN PATENT DOCUMENTS

| | | |
|---|---|---|
| 3241197 | 6/1983 | Fed. Rep. of Germany . |
| 2547310 | 12/1984 | France . |
| 2547309 | 12/1984 | France . |
| 2548210 | 1/1985 | France . |

OTHER PUBLICATIONS

Patent Abstracts of Japan, vol. 8, No. 122, (C-227)[1559], Jun. 8, 1984 and JP-A-59 33 395, (Kawasaki Seitetsu K.K.).

*Primary Examiner*—William R. Dixon, Jr.
*Assistant Examiner*—James M. Hunters, Jr.
*Attorney, Agent, or Firm*—Oblon, Fisher, Spivak, McClelland & Maier

[57] ABSTRACT

Novel cold rolling oils for steels comprise (A) 40 to 90 wt % of a monoester of an aliphatic carboxylic acid having 12 to 22 carbon atoms and an aliphatic alcohol having 1 to 12 carbon atoms, (B) 0.5 to 10 wt % of at least one of a dimer acid and a polymerized acid of a higher aliphatic unsaturated acid having 16 to 20 carbon atoms, (C) 2 to 40 wt % of a polyester having a molecular weight of 750 to 7500 and obtained by subjecting at least one of a dimer acid and a polymerized acid of a higher aliphatic unsaturated acid having 16 to 20 carbon atoms to condensation with a polyol under heating conditions and reacting remaining carboxyl groups of hydroxyl groups of the resulting polyester with an alcohol having 1 to 22 carbon atoms or an aliphatic acid having 12 to 22 carbon atoms, or 10 to 25 wt % of fat and fatty oils, and (D) 0.1 to 10 wt % of a polymer compound having nitrogen atoms in a molecule having a molecular weight of 1,000 to 1,000,000 such as a homopolymer or copolymer of monomers of the following general formula:

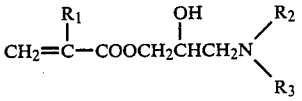

in which $R_1$ represents H or $CH_3$, $R_2$ and $R_3$ independently represent H or an alkyl group having 1 to 3 carbon atoms.

The cold rolling oils for steels have good lubricity, surface cleanability with excellent heat resistance and oxidative stability.

13 Claims, No Drawings

COLD ROLLING OIL FOR STEELS

BACKGROUND OF THE INVENTION (1) Field of the Invention

This invention relates to novel cold rolling oil for steels and more particularly, to cold rolling oils for steels which comprise a lubricating oil component and a water-soluble cationic polymer compound or a water-soluble amphoteric polymer compound and which have good lubricity, surface cleanability with excellent heat resistance and oxidative stability.

(2) Description of the Prior Art

In recent years, there is a tendency toward the use of a mill-clean rolling oil in order to omit the cleaning step in cold rolling. The mill clean rolling oil should meet the following two characteristic requirements.

(i) Free of any contamination or stain on the sheet surface caused by carbon component in a rolling oil during annealing with a good surface appearance being obtained (hereinafter referred to as a resistance to stain by annealing or mill cleanability).

(ii) Having good lubricity during rolling without involving a galling phenomenon called heat streak or a vibration phenomenon called chattering (hereinafter referred to as lubricity).

In order to make good mill cleanability of (i), it is general that the amounts, in rolling oils, of aliphatic acids, fat and fatty oils and organic polymer compounds which are apt to produce residual carbon on annealing are reduced as small as possible, but rolling oils comprised mainly of volatile or decomposable components, i.e. mineral oils and synthetic esters, are in use.

However, such rolling oils have poor adsorptivity on steel materials and poor oil film formability whithin a roll contact arc, thus being substantially poor in lubricity. If the lubricity of (ii) is intended to be improved, large amounts of fat and fatty oils and aliphatic acids have to be used such as in beef tallow rolling oils, leading to a lowering of mill cleanability.

The mill clean rolling oil which is provided for the purpose of omitting the cleaning step must satisfy the two requirements which are contrary to each other. Accordingly, existing mill clean rolling oils are applied only to sheet gage steels whose finished thickness is relatively large and which are rolled under mild conditions (e.g. a finished thickness over 0.8 mm).

The present inventors made intensive studies to provide lubricating oils for cold rolling which overcome the drawback of the known mill clean rolling oils and which met the above requirements (i) and (ii). As a result, it was found that a specific type of composition comprised of a predetermined amount of monoesters of aliphatic carboxylic acids and aliphatic alcohols, a predetermined amount of an ester which is obtained by subjecting at least one of a dimer acid and/or polymerized acid of a higher fatty unsaturated acid to condensation with polyols under heating conditions and reacting remaining carboxylic acid groups or hydroxyl groups of the resulting polyester with an alcohol or aliphatic acid, had good mill cleanability and lubricity without involving oil staining. This composition was applied for patent (Japanese Laid-open Application No. 59-33395).

However, recent rapid developments in rolling equipments and techniques enable one to permit a high rolling speed and mass production. This leads to a severer requirement for rolling oil with regard to lubricity, circulation stability, workability, waste water treatability and the like. There is now a further demand for development of rolling oils which satisfy this requirement.

It will be noted that the above requirement could not be met by conventional rolling oils using emulsifiers because of various difficulties involved therein. More specifically, with known rolling oils using emulsifiers, the type and amount of emulsifier were changed to change amounts of a rolling oil and an oil deposited on a rolled steel (i.e. plateout amount), thereby controlling rolling lubricity. In the rolling oil using emulsifiers, however, the plateout amount and the liquid circulation stability tend to conflict to each other. In other words, if the stability of emulsion is increased, the amount of plateout on rolled steel decreases with insufficient lubricity. On the contrary, when the plateout amount is increased, the emulsion becomes unstable, so that various troubles are involved on use by circulation.

SUMMARY OF THE INVENTION

The present inventors made intensive studies to provide metal rolling oil compositions which could be used under practically assumed high shearing conditions and under such high speed and high pressure conditions that the rolling speed is high and the reduction rate is large and whose process control was easy because of the good circulation stability. As a result, it was found that the above purpose could be achieved, according to one embodiment of the invention, by using a composition comprising a predetermined amount of monoesters obtained from aliphatic carboxylic acids and aliphatic alcohols, a predetermined amount of a dimer acid and/or a polymerized acid, and either a predetermined amount of an ester obtained by subjecting at least one of dimer acids and/or polymerized acids of higher fatty unsaturated acids to condensation with polyols under heating conditions and reacting remaining carboxylic acid groups or hydroxyl groups of the resulting polyester with alcohols or aliphatic acids or a predetermined amount of a fat and fatty oil such as beef tallow, lard or palm oil, in admixture with a specific type of water-soluble cationic polymer compound of water-soluble amphoteric polymer compound.

According to another embodiment of the invention, although the purpose of the invention can be satisfactorily attained by the above rolling oil composition, this base oil may further comprise specific types of antioxidants. By this, further advantages are produced in addition to the characteristics of the rolling oil according to the first embodiment of the invention: (1) when a rolling oil coolant is circulated over a long term, good resistances to thermal decomposition and thermal oxidative decomposition develop; and (2) even though the oil is contaminated with iron powder, scum and the like as is produced on rolling, the rolled steel has good defatting property and surface cleanability. Thus, the oil composition according to another embodiment of the invention can be imparted with such characteristics as to endure severe conditions as will be assumed in practical operations.

DETAILED DESCRIPTION OF THE INVENTION AND PREFERRED EMBODIMENTS

More particularly, the present invention provides a cold rolling oil for steels which comprises (A) 40 to 90 wt% of a monoester of an aliphatic carboxylic acid having 12 to 22 carbon atoms and an aliphatic alcohol having 1 to 12 carbon atoms, (B) 0.5 to 10 wt% of at least one of a dimer acid and a polymerized acid of a higher aliphatic unsaturated acid having 16 to 20 carbon atoms, (C) 2 to 40 wt% of a polyester having a molecular weight of 750 to 7500 and obtained by subjecting at least one of a dimer acid and a polymerized acid of a higher aliphatic unsaturated acid having 16 to 20 carbon atoms to condensation with a polyol under heating conditions and reacting remaining carboxyl groups or hydroxyl groups of the resulting polyester with an alcohol having 1 to 22 carbon atoms or an aliphatic acid having 12 to 22 carbon atoms, or 10 to 25 wt% of a fat and fatty oil, and (D) 0.1 to 10 wt% of a polymer compound having nitrogen atoms in a molecule having a molecular weight of 1000 to 100,000 and selected from the group consisting of the following (a) through (h). Moreover, the cold rolling oil may further comprise (E) each 0.3 to 10.0 wt% of at least two antioxidants selected from a phenolic antioxidant, a sulfur antioxidant, a phosphorus antioxidant and an amine antioxidant.

(a) A homopolymer or copolymer of two or more nitrogen-containing monomers of the following general formulae (I) through (IX) or salts thereof:

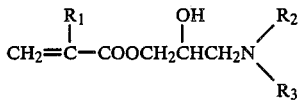

(I)

in which $R_1$ represents H or $CH_3$, $R_2$ and $R_3$ independently represent H or an alkyl group having 1 to 3 carbon atoms;

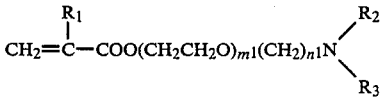

(II)

in which $m^1$ is a value of 1 to 3, $n^1$ is a value of 1 to 3, and $R_1$, $R_2$ and $R_3$ have the same meanings as defined above, respectively;

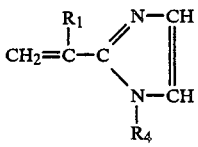

(III)

in which $R_4$ represents H, or an alkyl or alkylol group having 1 to 3 carbon atoms, and $R_1$ has the same meaning as defined in the formula (I);

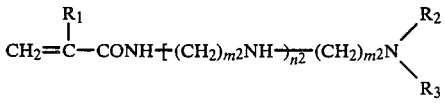

(IV)

in which $m^2$ and $n^2$ are, respectively, a value of 0 to 3, and $R_1$, $R_2$ and $R_3$ have the same meanings as defined in the formula (I);

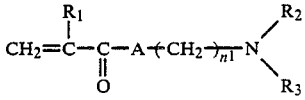

(V)

in which A represents —O— or —NH—, and $R_1$, $R_2$, $R_3$ and n have, respectively, the same meanings as defined in the formulae (I) and (II);

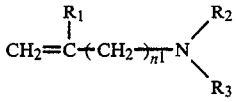

(VI)

in which $R_1$, $R_2$, $R_3$ and $n^1$ have, respectively, the same meanings as defined in the formulae (I) and (II);

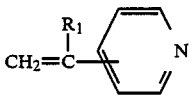

(VII)

in which $R_1$ has the same meaning as defined in the formula (I) and pyridine is substituted at the 2 or 4 position;

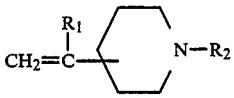

(VIII)

in which $R_1$ and $R_2$ have, respectively, the same meanings as defined in the formula (I) and pyridine is substituted at the 2 or 4 position; and

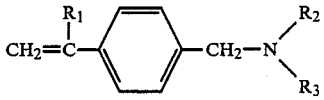

(IX)

in which $R_1$, $R_2$ and $R_3$ have, respectively, the same meanings as defined in the formula (I).

(b) Copolymers of one or more of the nitrogen-containing monomers of the general formulae (I) through (IX) or salts thereof and one or moe of vinyl monomers selected from the group consisting of $\alpha,\beta$-unsaturated carboxylic acids or salts or derivatives thereof, sulfonic acid group-containing vinyl compounds or salts thereof, acrylonitrile, vinyl pyrrolidone, and aliphatic olefins having 2 to 20 carbon atoms.

(c) Salts or quaternary ammonium salts of ring-opened polymer of ethyleneimine.

(d) Salts or quaternary ammonium salts of polycondensates of aliphatic dicarboxylic acids and polyethylene-polyamines or dipolyoxyethylenealkylamines.

(e) Dihaloalkane-polyalkylenepolyamine polycondensates.

(f) Epihalohydrin-amine polycondensates, (g) Salts of chitosan, or starch or cellulose, or cationized products thereof. The cationized products include inorganic salts, quaternary ammonium salts and the like.

(h) Polyether polyols or derivatives thereof having a molecular weight of 5000 to 600,000 and obtained by adding alkylene oxides to polyalkylimines having 6 to 200 nitrogen atoms or derivatives thereof.

The monoesters used as the base oil component in the practice of the invention are monoesters of aliphatic carboxylic acids having 12 to 22 carbon atoms and aliphatic alcohols having 1 to 12 carbon atoms and include, for example, methyl stearate, methyl behenate, butyl stearate, octyl stearate, lauryl stearate, methyl oleate, octyl oleate, decyl oleate, lauryl oleate, methyl palmitate, butyl palmitate, methyl esters of beef tallow fatty acids, octyl esters of beef tallow fatty acids, lauryl esters of beef tallow fatty acids, methyl esters of palm oil fatty acids, octyl esters of palm oil fatty acids, octyl esters of coconut oil fatty acids, lauryl esters of coconut oil fatty acids and the like. These esters have better mill cleanability and lubricity than mineral oils used as a base oil of ordinary mill clean rolling oils.

When aliphatic carboxylic acids having not less than 22 carbon atoms and aliphatic alcohols having not less than 12 carbon atoms are used to prepare esters, oil stain is produced in large amounts. On the other hand, when aliphatic carboxylic acids having not larger than 12 carbon atoms are used, the lubricity lowers. These esters are used in amounts ranging 40 to 90 wt% (hereinafter referred to simply as %). Over 90%, the dimer acid or polymerized acid of (B) and the fats or fatty oils such as beef tallow, palm oil or lard; and ester of ingredient (C) are reduced in amounts with a lowering of lubricity. On the other hand, when the amount is less than 40%, the ester in the base oil does not largely contribute to lower the oil staining ability, thus making it difficult to show the effect of improving the mill cleanability.

In the practice of the invention, dimer acids and/or polymerized acids of (B) and fat and fatty oils, such as beef tallow, palm oil and lard, or esters of (C) are added to the above esters to provide a base oil. These ingredients are essential. A rolling oil using such a base oil has lubricity equal to or better than an ordinary beef tallow rolling oil. Even when the rolling oil is deposited and remains on the surface of a rolled steel, little oil staining takes place in a subsequent annealing step. Thus, it becomes possible to further improve the lubricity.

The dimer acids and polymerized acids of (B) are dimer or polymerized acids of higher aliphatic monoene or diene acids having 16 to 20 carbon atoms. Examples of the acids include dimer and polymerized acids of zoomaric acid, oleic acid, linoleic acid, and gadoleic acid. These dimer and polymerized acids are used in an amount of 0.5 to 10% of the total composition. Over this range, oil stain generates considerably. With amounts less than the above range, the lubricity unfavorably lowers.

The fat and fatty oils of (C) are, for example, beef tallow, palm oil, lard and the like. The beef tallow may be crude beef tallow, refined beef tallow, edible beef tallow and the like. Preferably, purified and edible beef tallows are used. The palm oil may be crude palm oil, refined palm oil, and deacidified palm oil. Of these, refined and deacidified palm oils are preferred. The fat and fatty oils are used in an amount of 10 to 25% of the total composition. Over 25%, oil stain produces considerably. Amounts less than 10% are unfavorable because the lubricity lowers.

The esters of (C) which may be alternatively used instead of fat and fatty oils are esters having a molecular weight of 750 to 7500 and which are obtained by subjecting at least one of dimer or polymerized acids of higher aliphatic unsaturated acids having 16 to 20 carbon atoms to condensation with polyols under heating conditions and reacting remaining carboxyl groups or hydroxyl groups of the resulting polyester with alcohols having 1 to 20 carbon atoms or aliphatic acid having 12 to 22 carbon atoms.

The dimer or polymerized acids used herein may be the same dimer or polymerized acids as used in (B). The polyols include, for example, propylene glycol, ethylene glycol, dipropylene glycol, diethylene glycol, neopentyl glycol, butanediol, pentanediol, and hexanediol. Besides, polyoxypropylene glycol, polyoxyethdylene glycol, polyoxypropylenepolyoxyethylene glycol and the like may be mentioned. The alcohols having 1 to 22 carbon atoms include, for example, methanol, ethanol, butanol, heptyl alcohol, octyl alcohol, capryl alcohol, nonyl alcohol, decyl alcohol, stearyl alcohol, undecyl alcohol, lauryl alcohol, myristyl alcohol, palmityl alcohol, isostearyl alcohol, behenyl alcohol, oleyl alcohol and the like. The aliphatic acids having 12 to 22 carbon atoms include, for example, lauric acid, myristic acid, palmitic acid, stearic acid, isostearic acid, oleic acid, behenic acid and the like.

When the esters of (C) has a molecular weight smaller than 750, the lubricity becomes poor, whereas with a molecular weight higher than 7500, the miscibility in the system is poor with a high viscosity, thus unfavorably presenting a problem in handling. The ester of (C) is used in an amount of 2 to 40% of the total composition. When the amount exceeds 40%, oil stain occurs considerably. On the contrary, when the amount is less than 2%, the lubricity lowers unfavorably.

The water-soluble cationic or amphoteric polymer compounds represented in (a) through (h) of (D) may be used alone or in combination and are preferably used in an amount of 0.1 to 10% of the total amount of the cold rolling oil for steels.

The phenolic antioxidant which is one of the antioxidants of (E) used in the cold rolling oil according to another embodiment of the invention includes, for example, 2,6-di-tert-butyl-p-cresol, 2-tert-butyl-p-cresol, 2,6-di-tert-butylphenol, 3-methyl-6-tert-butylphenol, 2,4-di-tert-butylphenol, 2,5-di-tert-butyl-p-cresol, 3,5-di-tert-butyl-4-hydroxybenzyl alcohol, 2,4,6-tri-tert-butylphenol, cathecol, p-tert-butylcathecol, 4,6-di-tert-butyl-resorcin, 6-(4-oxy)-3,5-di-tert-butyl-anilino-2,4-bis-(n-octylthio)-1,3,5-triazine, (4-oxy-3,5-di-tert-butylbenzyl)-octadecyl phosphate, 4,4'-thiobis(3-methyl-6-tert-butylphenol), 4,4'-butylidenebis(3-methyl-6-tert-butylphenol), 2,2'-methylenebis(4-methyl-6-tert-butylphenol), 2,2'-thiobis(4,6-di-tert-butylresorcin), 2,2'-methylenebis(4-ethyl-6-tert-butylphenol), 4,4'-methylenebis(2,6-di-tert-butylphenol), 2,2'-(3,5-di-tert-butyl-4-hydroxy)propane, 4,4'-cyclohexylidenebis(2,6-di-tert-butylphenol), tetrakis[methylene-3-(3,5-di-tert-butyl-4-hydroxyphenyl)propionate]methane, hexamethyleneglycosebis[-(3,5-di-tert-butyl-4-hydroxyphenol)-propionate], 2,2'-thio[diethyl-bis-3(3,5-di-tert-butyl-4-hydroxyphenol)propionate], 1,3,5-trimethyl-2,4,6-tris(3,5-di-tert-butyl-4-hydroxybenzyl)benzene, bis-[3,3'-bis-(4'-hydroxy-3'-tert-butyl-phenyl)-butyric acid]-glycol ester, 1,3,5-tris-(4-tert-butyl-3-hydroxy-2,6-dimethylbenzyl]isocyanuric acid and the like.

The sulfur antioxidants include dilauryl thiodipropionate, dimyristyl thiodipropionate distearyl thiodipropionate, lauryl stearlyl thiodipropionate, distearyl-$\beta,\beta'$-thiodibutyrate, dilauryl sulfide, dioctadecyl sulfide, 2-mercaptobenzoimidazole, S-(3,5-di-tert-butyl-4-hydroxybenzyl)alkyl thioglycolate, 4,4'-thiobis(6-alkyl-3-methylphenol), N-oxy-diethylenebenzothiazyl sulfenamide, tetraalkyl-thiuram-disulfide, tetraalkyl-thiuram-monosulfide and the like.

The phosphorus antioxidants include triphenyl phosphite, trioctadecyl phosphite, tridecyl phosphite, trilauryl trithiophosphite, triallyl phosphite, di-(dinonylphenyl)-mono-(p-nonylphenyl)phosphite, diphenylisodecyl phosphite, o-[2-tert-butyl-5-methyl-4-(2-methyl-5-tert-butyl-4-(hydroxylphenylthio)phenyl]-S,S'-bis-(lauryl thio)phosphite, phenyldiisodecyl phosphite, phenyl-di-iso-octyl phosphite, tris(cyclohexylphenyl)phosphite, tris(o-cyclohexylphenyl)phosphite, tris(o-biphenyl)phosphite, tris(p-phenylphenol)phosphite, alkyl ($C_{8-12}$) cyclohexyl phosphite, alkyl ($C_{8-12}$) phenylcyclohexyl phosphite and the like.

The amine antioxidants include phenothiazine, N,N'-di-tert-butyl-p-phenylenediamine, 4,4'-tetramethyldiaminodiphenylmethane, 4-hydroxydiphenylamine, N-amino-N'-phenylparaphenylenediamine, N,N'-bis-(octylphenyl)amine, N,N'-diphenyl-p-phenylenediamine, N,N'-disalicylidene-1,2-diaminopropane, 4,4'-bis(4-$\alpha,\alpha'$-dimethylbenzyl)diphenylamine, 4,4'-dicumyldiphenylamine, N,N'-di-2-naphthyl-p-phenylnediamine, N,N'-ditolyl-p-phenylenediamine, N-amino-N-phenylparaphenylenediamine, N,N'-dicyclohexylparaphenylenediamine, N,N'-diphenyl-p-phenylenediamine and the like.

The phenolic, sulfur, phosphorus and amine antioxidants of (E) are each used in an amount of 0.3 to 10.0% of the total composition. Over this range, an adverse influence on the lubricity is given. On the other hand, when the amount of each antioxidant is less than 0.3%, the effect of the antioxidant develops only in an unfavorably reduced degree.

The cold rolling oil for steels according to the invention may comprise, aside from the above ingredients, known various additives, if necessary. Such additives include, for example, preservatives, extreme-pressure agents and the like. As a matter of course, the rolling oil according to the first embodiment of the invention may comprise one antioxidant of the type described above. The preservative, extreme-pressure agent and antioxidant may be added in amounts of 0 to 2%, 0 to 3% and 0 to 5%, respectively.

The preservatives include, for example, amines and derivatives thereof, alkenylsuccinic acids and derivatives thereof, phosphoric esters and derivatives thereof, and the like.

The extreme-pressure agents include, for example, phosphorus compounds such as trialkyl phosphates, trialkyl phosphites and the like, and organometallic compounds such as zinc salt of dialkyl thiophosphates.

The cold rolling oil of the invention is used by merely mixing the rolling oil ingredients and water-soluble polymers on application, or by preparing a concentrated solution having up to 80% of water and diluting the solution with water on use.

The mechanism of action of the polymer compound (D) used in the present invention is not completely known, but is presumably considered as follows. Water-soluble cationic or amphoteric polymer compounds which have been uniformly dissolved in a water phase adsorb, prior to commencement of coalescence, particles of lubricating oil components finely divided by the mechanical shearing force. The polymer compound serves to combine oil particles into larger-size particles by a kind of coagulation action. In addition, the polymer compound has such a steric and electric action of protective colloid that the larger-size particles can be stably dispersed in water.

The cold rolling oil for steels according to the invention permits lubricating oil components to be stably dispersed in water in large particle sizes by the protective-colloid function of the polymer compound (D). Accordingly, a stable distribution of relatively large sizes can be maintained under agitating conditions having a high shearing force such as by agitation in a tank or by a feed or circulation pump. When the oil is supplied to a portion to be rolled and contacts a rolled steel, oil particles of a large size form a thick, strong lubricating film on the rolled steel. Thus, the oil has a high lubricating, rolling performance and a good circulation stability, coupled with the advantage that the quality rarely changed with time. Moreover, the oil has the following advantages. The water-soluble cationic or amphoteric polymer compounds used in the present invention rapidly adsorb on liquid or solid particles and have the ability of rendering them hydrophilic. However, because the polymer compound is unstable to lower the interfacial tension between water and oil for emulsification, lubricating oil components are not emulsified. When compared with known rolling oils using emulsifiers, the oil of the invention has a less tendency to "take in" impurities such as stained oil and iron fin incorporated during actual rolling operations. Thus, the oil has such a prominent feature that it serves as an invariably clean rolling oil and can keep stable rolling, lubricating characteristics. The cold rolling oil of the invention can prevent contamination of a housing around a tank and a mill and is thus advantageous in that it can realize a clean operation environment as would have never been experienced with conventional rolling oils using emulsifiers.

A cold rolling oil composition, which comprises, aside from the rolling oil according to the first embodiment of the invention, at least two antioxidants selected from the group consisting of phenolic, sulfur, phosphorus and amine antioxidants, has good resistances to thermal decomposition and thermal oxidative decomposition and keeps stable and high lubricity over a long term of actual operations. In addition, this rolling oil composition can improve the cleanability of steel sheets after washing.

When compared with conventional rolling oils, the cold rolling oil of the invention is equal to or better than commercially available beef tallow rolling oils with regard to lubricity, is equal to or better than commercially available mineral oil-base rolling oils with regard to mill cleanability, and is better than conventional rolling oils with respect to stability of a dispersed state after use over a long term. The oil of the invention has further advantages in that although the prior art permits mill clean rolling of heavy-gage to medium-gauge steels alone, the oil of the invention makes it possible to extend the application of the mill clean rolling to light-gauge steels.

The present invention is described by way of examples.

EXAMPLE 1

Various rolling oils having the following formulations were subjected to the following tests. The reults are shown in Tables 1 and 2.

1. Rolling Oils (percent by weight)

-continued

| | |
|---|---|
| Rolling oils according to the first embodiment of the invention: | |
| No. 1 | |
| Ethyl stearate | 77 |
| Polymerized acid (1) | 1 |
| Ester (A) | 20 |
| Dispersant (A) | 1 |
| Phenolic antioxidant (A) | 1 |
| No. 2 | |
| Methyl ester of beef tallow fatty acids | 72 |
| Polymerized acid (2) | 4 |
| Refined beef tallow | 20 |
| Dispersant (B) | 3 |
| Phenolic antioxidant (B) | 1 |
| No. 3 | |
| 2-Ethylhexyl stearate | 80 |
| Polymerized acid (3) | 6 |
| Ester (B) | 10 |
| Dispersant (C) | 3 |
| Sulfur antioxidant (A) | 1 |
| No. 4 | |
| Butyl palmitate | 81 |
| Polymerized acid (4) | 10 |
| Ester (D) | 5 |
| Dispersant (D) | 3 |
| Phenolic antioxidant (C) | 1 |
| No. 5 | |
| Ethyl esters of palm oil fatty acids | 78 |
| Polymerized acid (5) | 3 |
| Deacidified palm oil | 15 |
| Dispersant (E) | 3 |
| Phosphate antioxidant (A) | 1 |
| No. 6 | |
| Lauryl esters of palm oil fatty acids | 80 |
| Polymerized acid (3) | 6 |
| Ester (C) | 10 |
| Dispersant (A) | 3 |
| Phenolic antioxidant (A) | 1 |
| No. 7 | |
| Methyl behenate | 75 |
| Polymerized acid (3) | 4 |
| Ester (C) | 15 |
| Dispersant (F) | 5 |
| Aromatic amine antioxidant (A) | 1 |
| (2) Rolling oil according to the second embodiment of the invention: | |
| No. 8 | |
| 2-Ethylhexyl stearate | 75 |
| Polymerized acid (1) | 2 |
| Ester (A) | 20 |
| Dispersant (B) | 1 |
| Phenolic antioxidant (A) | 1 |
| Phosphate antioxidant (B) | 1 |
| No. 9 | |
| Ethyl stearate | 71 |
| Polymerized acid (2) | 4 |
| Refined beef tallow | 20 |
| Dispersant (A) | 3 |
| Phenolic antioxidant (B) | 1 |
| Sulfur antioxidant (A) | 1 |
| No. 10 | |
| Butyl palmitate | 77 |
| Polymerized acid (3) | 5 |
| Ester (B) | 10 |
| Dispersant (C) | 3 |
| Sulfur antioxidant (B) | 4 |
| Phosphate antioxidant (C) | 1 |
| No. 11 | |
| Methyl behenate | 78.5 |
| Polymerized acid (4) | 9 |
| Ester (D) | 5 |
| Dispersant (D) | 3 |
| Phenolic antioxidant (C) | 4 |
| Amine antioxidant (A) | 0.5 |
| 2. Rolling oils for comparison | |
| No. 1 | |
| Butyl stearate | 87.7 |
| Polymerized acid (1) | 0.3 |
| Ester (A) | 5 |

-continued

| | |
|---|---|
| Surface active agent (A) | 4 |
| Phenolic antioxidant (A) | 1 |
| Phosphate extreme-pressure agent | 1 |
| No. 2 | |
| Methyl esters of beef tallow fatty acids | 48 |
| Polymerized acid (3) | 20 |
| Ester (A) | 25 |
| Surface active agent (a) | 5 |
| Phenolic antioxidant (B) | 1 |
| Phosphate extreme-pressure agent | 1 |
| No. 3 | |
| Refined beef tallow | 94 |
| Polymerized acid (1) | 2 |
| Surface active agent (c) | 3 |
| Phenolic antioxidant (C) | 1 |
| No. 4 | |
| Butyl stearate | 63 |
| Ester (A) | 30 |
| Beef tallow fatty acids | 2 |
| Surface active agent (a) | 3 |
| Phenolic antioxidant (A) | 1 |
| Phosphate extreme-pressure agent | 1 |
| No. 5 | |
| Ethyl stearate | 72 |
| Polymerized acid (1) | 1 |
| Ester (A) | 20 |
| Surface active agent (b) | 5 |
| Phenolic antioxidant (A) | 1 |
| Phosphate extreme-pressure agent | 1 |
| No. 6 | |
| Commercially sold beef tallow rolling oil | |
| No. 7 | |
| Commercially sold mineral oil-base rolling oil | |

In the above formulations, the polymerized acids, esters, dispersants, surface active agents and antioxidants are intended to mean the following substances or compounds.

Polymerized acid (1): polymerized acids of tall oil fatty acid (dimer acid:polymerized acids including trimer and higher acids=7:3).

Polymerized acid (2): polymerized acids of oleic acid and linoleic acid (mixing ratio of 2:1) (dimer acid:-polymerized acids including trimer and higher acids=5:5).

Polymerized acid (3): polymerized acids of oleic acid (dimer acid:polymerized acids including trimer and higher acids=7:3).

Polymerized acid (4): polymerized acids of soybean oil fatty acids (dimer acid:polymerized acids including trimer and higher acids=6:4).

Polymerized acid (5): polymerized acids of zoomaric acid and oleic acid (mixing ratio of 1:2) (dimer acid:-polymerized acids including trimer and higher acids=8:2).

Ester (A): an ester obtained by subjecting 100 g of polymerized acid (1) and 25 g of diethylene glycol to condensation in a stream of nitrogen under heating conditions of 220° C. at a normal pressure to obtain a polyol-polyester (hydroxyl value=53) and then subjecting 100 g of the thus obtained polyol-polyester and 24 g of isostearic acid (acid value=205) to condensation under heating conditions of 220° C. in a stream of nitrogen at a normal pressure, the ester having a hydroxyl value of 8, an acid value of 5, and an average molecular weight of 2000.

Ester (B): an ester obtained by subjecting 100 g of polymerized acid (2) and 22 g of propylene glycol to condensation in a stream of nitrogen under heating conditions of 220° C. at a normal pressure to obtain a polyol-polyester (hydroxyl value=122) and then subjecting 100 g of the thus obtained polyol-polyester and 29 g of behenic acid (acid value=161) to condensation under heating conditions of 220° C. in a stream of nitrogen at a normal pressure, the ester having a hydroxyl value of 8, an acid value of 7, and an average molecular weight of 1500.

Ester (C): an ester obtained by subjecting 100 g of polymerized acid (3) and 40 g of polyethylene glycol (average molecular weight=200) to condensation in a stream of nitrogen under heating conditions of 220° C. at a normal pressure to obtain a polyol-polyester (hydroxyl value=23) and then subjecting 100 g of the thus obtained polyol-polyestr and 10 g of palmitic acid (acid value=218) to condensation under heating conditions of 220° C. in a stream of nitrogen at a normal pressure, the ester having a hydroxyl value of 6, an acid value of 5, and an average molecular weight of 4000.

Ester (D): an ester obtained by subjecting 100 g of polymerized acid (3) and 10 g of diethylene glycol to condensation in a stream of nitrogen under heating conditions of 220° C. at a normal pressure to obtain a polyol-polyester (hydroxy value=77) and then subjecting 100 g of the thus obtained polyol-polyester and 38 g of stearyl alcohol (hydroxyl value=205) to condensation under heating conditions of 220° C. in a stream of nitrogen at a normal pressure, the ester having a hydroxyl value of 7, an acid value of 6, and an average molecular weight of 1300.

Dispersant (A): copolymer (MW=110,000) of glycollate of methacryldimethylaminoethyl ethoxylate/ethylene imine=1/1 (molar ratio).

Dispersant (B): copolymer (MW=10,000) of phosphate of diethylaminoethyl methacrylate/sodium methacrylate=4/2 (molar ratio).

Dispersant (C): copolymer (MW=180,000) of borate of dimethylaminoethyl methacrylate/vinyl pyrrolidone/sodium acrylate=6/2/2 (molar ratio).

Dispersant (D): copolymer (MW=300,000) of methyl phosphonate of diethylaminoethyl methacrylate/sodium acrylate/sodium vinylsulfonate=4/1/1.

Dispersant (E): quaternary ammonium salt of cationized cellulose.

Dispersant (F): mixture of dispersants (A) and (D) in a mixing ratio of 1:1.

Surface active agent (a): polyoxyethylene nonylphenyl ether (the number of moles of added ethylene oxide, n, =6).

Surface active agent (b): polyoxyethylene lauryl ether (the number of moles of added ethylene oxide, n, =5).

Surface active agent (c): polyoxyethylene monostearate (the number of moles of added ethylene oxide, n, =7).

Phenolic antioxidant (A): 2,5-di-tert-butyl-p-cresol.

Phenolic antioxidant (B): 4,4'-butylidenebis(3-methyl-6-tert-butylphenol).

Phenolic antioxidant (C): tetrakis[methylene-3-(3,5-di-tert-butyl-4-hydroxyphenyl)propionate]methane.

Sulfur antioxidant (A): laury stearyl thiodipropionate.

Sulfur antioxidant (B): 5-(3,5-di-tert-butyl-4-hydroxybenzyl)-alkylthioglycollate.

Phosphate antioxidant (A): triallyl phosphite.

Phosphate antioxidant (B): phenyl-di-isooctyl phosphite.

Phosphate antioxidant (C): tris(o-biphenyl)phosphite.

Amine antioxidant (A): N,N'-tert-butyl-p-phenylenediamine.

I. Test Items and Test Methods (1) Lubricating property

A Timken tester was used and each rolling oil was diluted with water to an extent of 5% in concentration, followed by agitating by means of a homogenizer at 10,000 r.p.m., thereby obtaining a rolling oil dispersion of 50° C. in a tank for subsequent circulation. The evaluation was made using an area (OK area) within a galling limit curve defined by connecting a load and the number of revolutions immediately prior to commencement of the galling and indicated as a ratio to the poorest which was taken as 1.0.

(2) Resistance to stain by annealing

Iron powder (particle size below 5 micrometers) was added to each dispersion having a rolling oil concentration of 5% in an amount of 0.3%, thereby preparing a rolling oil dispersion of 60° C. in a tank. This dispersion was sprayed over the surface of a test steel plate from a nozzle by the use of a gear pump (0.5 1/min., 1 atom., 2 seconds), followed by drying by air purge, superposing the two dried plates, bringing the superposed plates into contact with each other under a load of 40 k/cm$^2$ and heating at 130° C. for 15 hours. Thereafter, the plates were annealed in an annealing furnace of an atmosphere of a mixed gas of $N_2$+5%$H_2$ at 700° C. for 2 hours. the thus annealed plate was visually observed on the surface appearance thereof. The appearance was evaluated by five ranks and the poorest appearance was indicated at 5.

(3) Long-term circulation stability of dispersion 0.3% of iron powder (particle size below 5 micrometers) was added to each dispersion having a rolling oil concentration of 5% to prepare a rolling oil dispersion of 60° C. in a tank. The dispersion was continuously circulated and jetted over an iron roll heated to 150° C. by use of a gear pump at a pressure of 2.5 kg/cm$^2$. After 48 hours, the oil component in the dispersion except for a floating oil in the upper layer was extracted and weighed, from which a reduction rate relative to the initially charged oil was determined.

(4) Waste water-treating test

Rolling oil dispersions (1 liter) were prepared in the same manner as in Test (1), to which 3 g of aluminum sulfate. Subsequently, the mixture was agitated for 2 minutes, followed by further adding $Ca(OH)_2$ to adjust the pH to 7.0 and further agitating for 10 minutes. Thereafter, the mixture was allowed to stand and the resultant supernatant liquid was collected and subjected to measurement of COD ($KMnO_4$ method).

As will be apparent from the results of Tables 1 and 2, the cold rolling oils for steels according to the invention have better lubricity, resistance to stain by annealing, long-term circulation stability of dispersions thereof, waste water treatability than comparative rolling oils conventionally used for these purpose.

TABLE 1

| Rolling Oil No. | Characteristics: Lubricity | Characteristics: Resistance to Stain by Annealing |
|---|---|---|
| Rolling oils of first embodiment of the invention: | | |
| 1 | 2.45 | 1 |
| 2 | 2.60 | 1–2 |
| 3 | 2.55 | 1 |
| 4 | 2.40 | 1–2 |
| 5 | 2.35 | 1 |

TABLE 1-continued

| Rolling Oil No. | Characteristics: Lubricity | Characteristics: Resistance to Stain by Annealing |
|---|---|---|
| 6 | 2.50 | 1 |
| 7 | 2.65 | 1 |
| Rolling oils of second embodiment of the invention: | | |
| 8 | 2.50 | 1 |
| 9 | 2.60 | 1 |
| 10 | 2.55 | 1 |
| 11 | 2.60 | 1 |
| Rolling oils for comparison: | | |
| 1 | 1.50 | 2-3 |
| 2 | 2.30 | 3 |
| 3 | 2.15 | 5 |
| 4 | 1.70 | 2-3 |
| 5 | 1.90 | 2-3 |
| 6 | 1.85 | 5 |
| 7 | 1.00 | 2-3 |

TABLE 2

| Rolling oil No. | Floating oil content in upper layer (circulation time: 48 hrs) (reduction rate based on initially charged oil) wt % | COD (ppm) |
|---|---|---|
| Rolling oils of first embodiment of the invention: | | |
| 1 | 9 | 158 |
| 2 | 6 | 160 |
| 3 | 7 | 159 |
| 4 | 16 | 311 |
| 5 | 17 | 365 |
| 6 | 7 | 165 |
| 7 | 6 | 171 |
| Rolling oils of second embodiment of the invention: | | |
| 8 | 7 | 148 |
| 9 | 6 | 155 |
| 10 | 6 | 154 |
| 11 | 7 | 156 |
| Rolling oils for comparison: | | |
| 1 | 27 | 1820 |
| 2 | 32 | 2110 |
| 3 | 41 | 1720 |
| 4 | 30 | 1750 |
| 5 | 28 | 2320 |
| 6 | 52 | 2810 |
| 7 | 38 | 2930 |

What is claimed is:

1. A water emulsifiable cold rolling oil for steels comprising:

(A) 40 to 90 wt.% of a monoester of a $C_{12-22}$ carbon atom content aliphatic carboxylic acid and a $C_{1-12}$ carbon atom content aliphatic alcohol;

(B) 0.5 to 10 wt.% of at least one dimer acid or polymerized acid prepared from a $C_{16-20}$ carbon atom content aliphatic unsaturated acid;

(C) (i) 2 to 40 wt% of a polyester having a molecular weight of 750 to 7500 which is obtained by heating at least one dimer acid or polymerized acid prepared from a $C_{16-20}$ carbon atom content aliphatic unsaturated acid with a polyol, thereby forming a polyester and reacting the remaining carboxyl groups or hydroxyl groups of the resulting polyester with an alcohol having 1 to 22 carbon atoms or an aliphatic acid having 12 to 22 carbon atoms, or (ii) 10 to 25 wt% of a fat and fatty oil; and (D) 0.1 to 10 wt% of a polymer compound containing nitrogen atoms in a molecule having a molecular weight of 1000 to 1000,000, said molecule being selected from the group consisting of compounds of formulas (a) through (h):

(a) a homopolymer or copolymer of nitrogen-containing monomers of the following formulae (I) through (IX) of salts thereof:

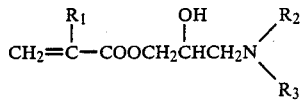

(I)

in which $R_1$ represents H or $CH_3$, $R_2$ and $R_3$ independently represent H or an alkyl group having 1 to 3 carbon atoms;

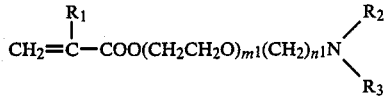

(II)

in which $m^1$ is a value of 1 to 3, $n^1$ is a value of 1 to 3, and $R_1$, $R_2$ and $R_3$ have the same meanings as defined above, respectively;

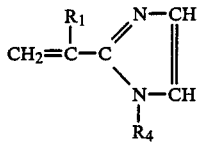

(III)

in which $R_4$ represents H, or an alkyl or alkylol group having 1 to 3 carbon atoms, and $R_1$ has the same meaning as defined in formula (I):

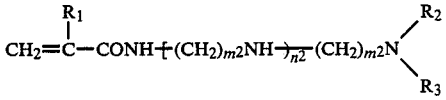

(IV)

in which $m^2$ and $n^2$ are, respectively, a value of 0 to 3, and $R_1$, $R_2$ and $R_3$ have the same meanings as defined in formula (I):

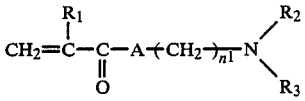

(V)

in which A represents —O— or —NH—, and $R_1$, $R_2$, $R_3$ and n have the same meanings as defined in formulae (I) and (II):

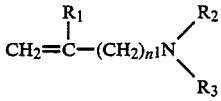

(VI)

in which $R_1$, $R_2$, $R_3$ and $n^1$ have the same meanings as defined in formulae (I) and (II):

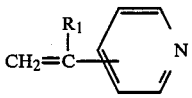

(VII)

in which $R_1$ has the same meaning as defined in formula (I) and pyridine is substituted at the 2 or 4 position;

(VIII)

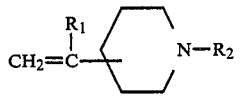

in which $R_1$ and $R_2$ have, respectively, the same meanings as defined in formula (I) and pyridine is substituted at the 2 or 4 position; and (IX)

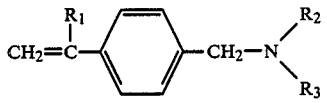

in which $R_1$, $R_2$ and $R_3$ have, respectively, the same meanings as defined in formula (I);

(b) copolymers of at least one of the nitrogen-containing monomers of formulae (I) through (IX) or salts thereof and at least one vinyl monomer selected from the group consisting of $\alpha,\beta$-unsaturated carboxylic acids or salts or derivatives thereof, sulfonic acid group-containing vinyl compounds or salts thereof, acrylonitrile, vinyl pyrrolidone, and aliphatic olefins having 2 to 20 carbon atoms;

(c) salts or quaternary ammonium salts of ring-opened polymers of ethyleneimine;

(d) salts or quaternary ammonium salts of polycondensates of aliphatic dicarboxylic acids and polyethylene-polyamines or dipolyoxyethylenealkylamines;

(e) dihaloalkane-polyalkylenepolyamine polycondensates;

(f) epihalohydrin-amine polycondensates;

(g) salts of chitosan, or starch or cellulose or cationized products thereof; and (h) polyether polyols or derivatives thereof having a molecular weight of 5000 to 600,000 and obtained by adding alkylene oxides to polyalkylimines having 6 to 200 nitrogen atoms or derivatives thereof.

2. The rolling oil of claim 1, wherein said monoester of component (A) is a member selected from the group consisting of methyl stearate, methyl behenate, butyl stearate, octyl stearate, lauryl stearate, methyl oleate, octyl oleate, decyl oleate, lauryl oleate, methyl palmitate, butyl palmitate, methyl esters of beef tallow fatty acids, octyl esters of beef tallow fatty acids, lauryl esters of beef tallow fatty acids, methyl esters of palm oil fatty acids, octyl esters of palm oil fatty acids, octyl esters of coconut oil fatty acids.

3. The rolling oil of claim 1, wherein said $C_{16-20}$ carbon atom content aliphatic unsaturated acid of components (B) and (C) is zoomaric acid, oleic acid, linoleic acid or gadoleic acid.

4. The rolling oil of claim 1, wherein said fat or fatty oil of component (C) is a member selected from the group consisting of beef tallow, palm oil or lard.

5. The rolling oil of claim 1, wherein the polyol reactant of component (C) is propylene glycol, ethylene glycol, dipropylene glycol, diethylene glycol, neopentyl glycol, butanediol, pentanediol, hexanediol, polyoxypropylene glycol, polyoxyethylene glycol or polyoxypropylene-polyoxyethylene glycol.

6. The rolling oil of claim 1, wherein said $C_{1-22}$ carbon atom content alcohol of component (C) is a member selected from the group consisting of methanol, ethanol, butanol, heptyl alcohol, octyl alcohol, capryl alcohol, nonyl alcohol, decyl alcohol, stearyl alcohol, undecyl alcohol, lauryl alcohol, myristyl alcohol, palmityl alcohol, isostearyl alcohol, behenyl alcohol or oleyl alcohol.

7. The rolling oil of claim 1, wherein said $C_{12-22}$ carbon atom content aliphatic acid is a member selected from the group consisting of lauric acid, myristic acid, palmitic acid, stearic acid, isostearic acid, oleic acid, or behenic acid.

8. A water emulsifiable cold rolling oil for steels, comprising:

(A) 40 to 90 wt.% of a monoester of a $C_{12-22}$ carbon atom content aliphatic carboxylic acid and a $C_{1-12}$ carbon atom content aliphatic alcohol;

(B) 0.5 to 10 wt.% of at least one dimer acid or polymerized acid prepared from a $C_{16-20}$ carbon atom content aliphatic unsaturated acid;

(C) (i) 2 to 40 wt% of a polyester having a molecular weight of 750 to 7500 which is obtained by heating at least one dimer acid or polymerized acid prepared from a $C_{16-20}$ carbon atom content aliphatic unsaturated acid with a polyol, thereby forming a polyester and reacting the remaining carboxyl groups or hydroxyl groups of the resulting polyester with an alcohol having 1 to 22 carbon atoms or an aliphatic acid having 12 to 22 carbon atoms, or (ii) 10 to 25 wt% of a fat and fatty oil;

(D) 0.1 to 10 wt% of a polymer compound containing nitrogen atoms in a molecule having a molecular weight of 1000 to 1000,000, said molecule being selected from the group consisting of compounds of formulas (a) through (h):

(a) a homopolymer or copolymer of at least two nitrogen-containing monomers of the following formulae (I) through (IX) or salts thereof:

(I)

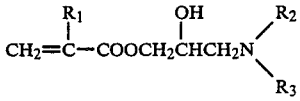

in which $R_1$ represents H or $CH_3$, $R_2$ and $R_3$ independently represent H or an alkyl group having 1 to 3 carbon atoms;

(II)

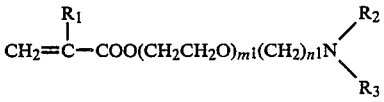

in which $m^1$ is a value of 1 to 3, $n^1$ is a value of 1 to 3, and $R_1$, $R_2$ and $R_3$ have the same meanings as defined above, respectively;

(III)

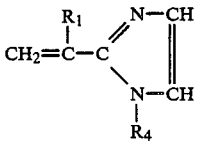

in which $R_4$ represents H, or an alkyl or alkylol group having 1 to 3 carbon atoms, and $R_1$ has the same meaning as defined in formula (I);

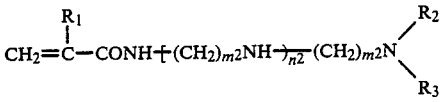

(IV)

in which $m^2$ and $n^2$ are, respectively, a value of 0 to 3, and $R_1$, $R_2$ and $R_3$ have the same meanings as defined in formula (I);

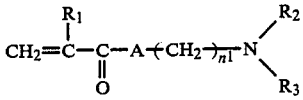

(V)

in which A represents —O— or —NH—, and $R_1$, $R_2$, $R_3$ and n have the same meanings as defined in formulae (I) and (II);

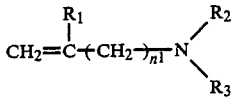

(VI)

in which $R_1$, $R_2$, $R_3$ and $n^1$ have the same meanings as defined in formulae (I) and (II);

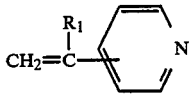

(VII)

in which $R_1$ has the same meaning as defined in formula (I) and pyridine is substituted at the 2 or 4 position;

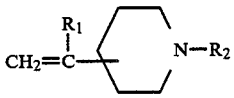

(VIII)

in which $R_1$ and $R_2$ have, respectively, the same meanings as defined in formula (I) and pyridine is substituted at the 2 or 4 position; and

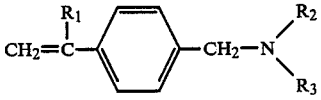

(IX)

in which $R_1$, $R_2$ and $R_3$ have, respectively, the same meanings as defined in formula (I);

(b) copolymers of at least one of the nitrogen-containing monomers of at least formulae (I) through (IX) or salts thereof and at least one vinyl monomer selected from the group consisting of $\alpha,\beta$-unsaturated carboxylic acids or salts or derivatives thereof, sulfonic acid group-containing vinyl compounds or salts thereof, acrylonitrile, vinyl pyrrolidone, and aliphatic olefins having 2 to 20 carbon atoms;

(c) salts or quaternary ammonium salts of ring-opened polymers of ethyleneimine;

(d) salts or quaternary ammonium salts of polycondensates of aliphatic dicarboxylic acids and polyethylene-polyamines or dipolyoxyethylenealkylamines;

(e) dihaloalkane-polyalkylenepolyamine polycondensates;

(f) epihalohydrin-amine polycondensates;

(g) salts of chitosan, or starch or cellulose or cationized products thereof; and (h) polyether polyols or derivatives thereof having a molecular weight of 5000 to 600,000 and obtained by adding alkylene oxides to polyalkylimines having 6 to 200 nitrogen atoms or derivatives thereof; and (E) 0.3 to 10.0 wt% each of at least two anitoxidants selected from the group consisting of a phenolic antioxidant, a sulfur antioxidant, a phosphorus antioxidant and an amine antioxidant.

9. The rolling oil of claim 8, wherein said phenolic antioxidant is a member selected from the group consisting of 2,6-di-tert-butyl-p-cresol, 2-tert-butyl-p-cresol, 2,6-di-tert-butylphenol, 3-methyl-6-tert-butylphenol, 2,4-di-tert-butylphenol, 2,5-di-tert-butyl-p-cresol, 3,5-di-tert-butyl-4-hydroxybenzyl alcohol, 2,4,6-tri-tert-butylphenol, catechol, p-tertbutylcatechol, 4,6-tert-butyl-resorcin, 6-(4-oxy)-3,5-di-tert-butyl-anilino-2,4-bis-(n-octylthio)-1,3,5-triazine, (4-oxy-3,5-di-tert-butyl-benzyl)octadecyl phosphate, 4,4'-thiobis (3-methyl-6-tert-butylphenol), 4,4'-butylidenebis(3-methyl-6-tert-butylphenol), 2,2'methylenebis(4-methyl-6-tert-butylphenol), 2,2'thiobis(4,6-di-tert-butylresorcin), 2,2'-methylenebis(4-ethyl-6-tert-butylphenol), 4,4'-methylenebis(2,6-di-tert-butylphenol), 2,2'-(3,5-di-tert-butyl-4-hydroxy)propane, 4,4'-cyclohexylidenebis(2,6-di-tert-butylphenol), tetrakis[methylene-3-(3,5-di-tert-butyl-4-hydroxyphenyl)propionate]methane, hexamethyleneglycosebis[-3,5-di-tert-butyl-4-hydroxyphenol)-propionate], 2,2'thio[diethyl-bis-3(3,5-di-tert-butyl-4-hydroxyphenol)propionate], 1,3,5-trimethyl-2,4,6-tris(3,5-di-tert-butyl-4-hydroxybenzyl)benzene, bis-[3,3'-bis-(4'-hydroxy-3'-tert-butyl-phenyl)-butyric acid]-glycol ester, and 1,3,5-tris-(4-tert-buty-3-hydroxy-2,6-dimethylbenzyl)isocyanuric acid.

10. The rolling oil of claim 1, wherein said sulfur antioxidant is a member selected from the group consisting of dilauryl thiodipropionate, dimyristyl thiodipropionate, distearyl thiodipropionate, lauryl stearlyl thiodipropionate, distearyl-$\beta,\beta'$-thiodibutyrate, dilauryl sulfide, dioctadecyl sulfide, 2-mercaptobenzoimidazole, S-(3,5-di-tert-butyl-4-hydroxybenzyl)alkyl thioglycolate, 4,4'-thiobis(6-alkyl-3-methylphenol), N-oxy-diethylene-benzothiazyl sulfenamide, tetraalkyl-thiuram-disulfide, and tetraalkyl-thiuram-monosulfide.

11. The rolling oil of claim 8, wherein said phosphorus antioxidant in a member selected from the group consisting of triphenyl phosphite, trioctadecyl phosphite, tridecyl phosphite, trilauryl trithiophosphite, triallyl phosphite, di(dinonylphenyl)-mono-(p-nonylphenyl)phosphite, diphenylisodecyl phosphite, o-[2-tert-butyl-5-methyl-4(2-methyl-5-tert-butyl-4-(hydroxylphenylthio)phenyl]-S,S'-bis-(lauryl thio)phosphite, phenyldiisodecyl phosphite, phenyl-di-iso-octyl phosphite, tris(cyclohexylphenyl)phosphite, tris(o-cyclohexylphenyl)phosphite, tris(o-biphenyl)phosphite, tris(p-phenylphenol)phosphite, alkyl ($C_{8-12}$) cyclohexyl phosphite, and alkyl ($C_{8-12}$) phenylcyclohexyl phosphite.

12. The rolling oil of claim 8, wherein said amine antioxidant is a member selected from the group consisting of phenothiazine, N,N'-di-tert-butyl-p-phenylenediamine, 4,4'-tetramethyl-diaminodiphenylmethane, 4-hydroxydiphenylamine, N-amino-N'-phenylparaphenylenediamine, N,N'-bis(octylphenyl)amine, N,N'-diphenyl-p-phenylenediamine, N,N'-disalicylidene-1,2-diaminopropane, 4,4'-bis(4-$\alpha,\alpha'$-dimethylbenzyl)diphenylamine, 4,4'-dicumyldiphenylamine, N,N'-di-2-naphthyl-p-phenylenediamine, N,N'-ditolyl-p-phenylenediamine, N-amino-N-phenyl paraphenylenediamine, N,N'-dicyclohexylparaphenylenediamine and N,N'-diphenyl-p-phenylenediamine.

13. The rolling oil of claim 1, wherein the components of said composition are emulsified with up to 80% water.

* * * * *

UNITED STATES PATENT AND TRADEMARK OFFICE

CERTIFICATE OF CORRECTION

PATENT NO. : 4,746,448

DATED : May 24, 1988

INVENTOR(S) : Kazuhito Kenmochi, et al.

It is certified that error appears in the above-identified patent and that said Letters Patent is hereby corrected as shown below:

On the Title Page, Item [73]

The first Assignee, Kao Corporation, is located in Tokyo, Japan, not in Kobe, Japan.

Signed and Sealed this

Twentieth Day of September, 1988

*Attest:*

DONALD J. QUIGG

*Attesting Officer*

*Commissioner of Patents and Trademarks*